United States Patent [19]

Meyer et al.

[11] 4,143,482

[45] Mar. 13, 1979

[54] AMUSEMENT DEVICE

[75] Inventors: Burton C. Meyer, Downers Grove; Donald F. Nix, Hanover Park; Allison W. Katzman, Chicago, all of Ill.

[73] Assignee: Marvin Glass & Associates, Chicago, Ill.

[21] Appl. No.: 803,476

[22] Filed: Jun. 6, 1977

[51] Int. Cl.[2] ..... A63H 33/00

[52] U.S. Cl. ..... 46/43; 46/1 R; 46/140

[58] Field of Search ..... 46/1 R, 1 C, 1 K, 43, 46/137, 140, 138; 273/86 E, 86 F

[56] References Cited

U.S. PATENT DOCUMENTS

| | | | |
|---|---|---|---|
| 1,274,979 | 8/1918 | Bliley | 46/43 |
| 1,389,372 | 8/1921 | Mitera | 46/140 |
| 1,569,549 | 1/1926 | Keppner | 46/1 R |
| 1,923,244 | 8/1933 | Vickers | 46/1 R |
| 3,102,647 | 9/1963 | Bonney | 56/328 R |
| 3,630,401 | 12/1971 | Gustafson | 56/328 R |
| 3,721,036 | 3/1973 | Goldfarb | 46/43 |

*Primary Examiner*—Russell R. Kinsey
*Assistant Examiner*—Mickey Yu
*Attorney, Agent, or Firm*—Mason, Kolehmainen, Rathburn & Wyss

[57] ABSTRACT

An amusement device provides a skating rink for use with figure toys or the like. The amusement device includes a plurality of rotatable disc-shaped rink portions mounted on the base adjacent a panoramic setting. The setting includes a recirculating device which receives the figure toys from one end of the rink and elevates the figure toys to a chute which delivers the figure toys generally to a position at the opposite end of the rink. A ski lift mechanism including a plurality of chairs is adapted to carry the various figure toys at an elevated position over the top of the rink. A common linkage drives the rotatable rink portions, the recirculating system, and the ski lift mechanism.

23 Claims, 5 Drawing Figures

AMUSEMENT DEVICE

BACKGROUND OF THE INVENTION

1. Field of the Invention

The present invention is directed to devices for use in conjunction with figure toys such as play kits which simulate real life activities.

2. Brief Description of the Prior Art

Many combination or kit-type devices have been provided for use with figure toys such as race sets, western camping sets, farm adventure sets and the like. All of the prior art devices have provided much enjoyment and entertainment, particularly those suited for children.

SUMMARY OF THE INVENTION

An object of the present invention is to provide a new and improved amusement device which is particularly suited for use with figure toys.

In accordance with the above and other objects, the present invention provides an amusement device including a skating rink comprising a pair of rotatable disc-shaped rink portions and a recirculating device which receives the figure toys from one end of the rink and elevates the figure toys to a chute portion which delivers the figure toys generally to a position at the opposite end of the rink. A ski lift type mechanism spans the rink portion to transport various figure toys at an elevated position over the top of the rink in a continuous path of travel. A common manually operable drive means simultaneously rotates the rink portions, operates the recirculating device and powers the ski lift mechanism.

Other objects, features and advantages of the invention will be apparent from the following detailed description taken in connection with the accompanying drawings.

DESCRIPTION OF THE PREFERRED EMBODIMENT

Figure 1:
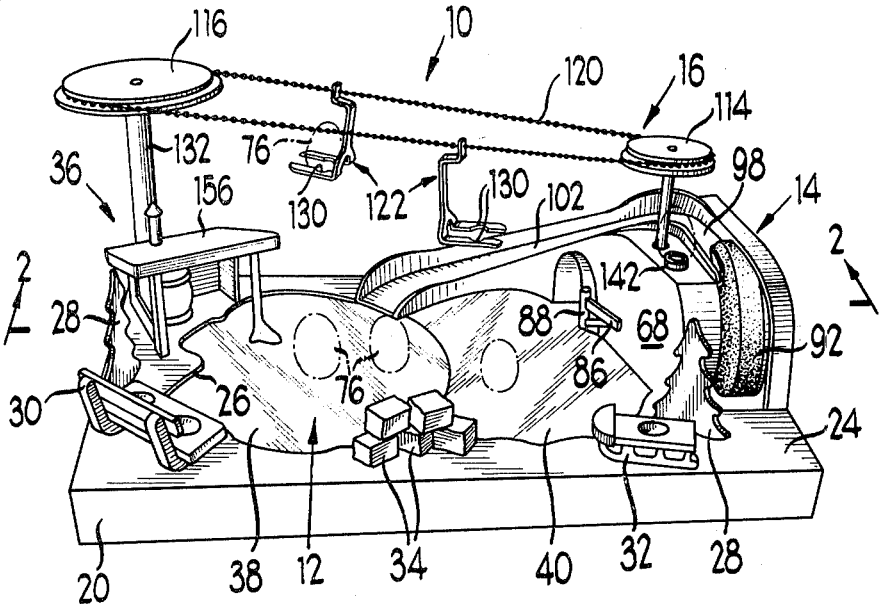
FIG. 1 is a perspective view of an amusement device made in accordance with the concepts of the present invention.

An amusement device made in accordance with the concepts of the present invention is shown in FIG. 1, and is generally designated 10. The amusement device 10 includes a plurality of elements including a skating rink portion, generally designated 12, a recirculating mechanism, generally designated 14.

The amusement device 10 includes a generally rectangular base portion 20 defined by a base plate 22 and a plurality of generally vertical peripheral walls which support a generally horizontal top surface 24 (FIG. 2) above the base plate. The top surface 24 referring to FIG. 3, includes a generally centrally located irregularly shaped cutout which defines an irregular periphery 26 similar to the natural edge of a lake. A plurality of items including fir trees 28, a bench 30, a sled 32, ice blocks 32, and a shelter, generally designated 36, are positioned around the periphery 26 of the rink 12 to add a life-like appearance.

Figure 2:
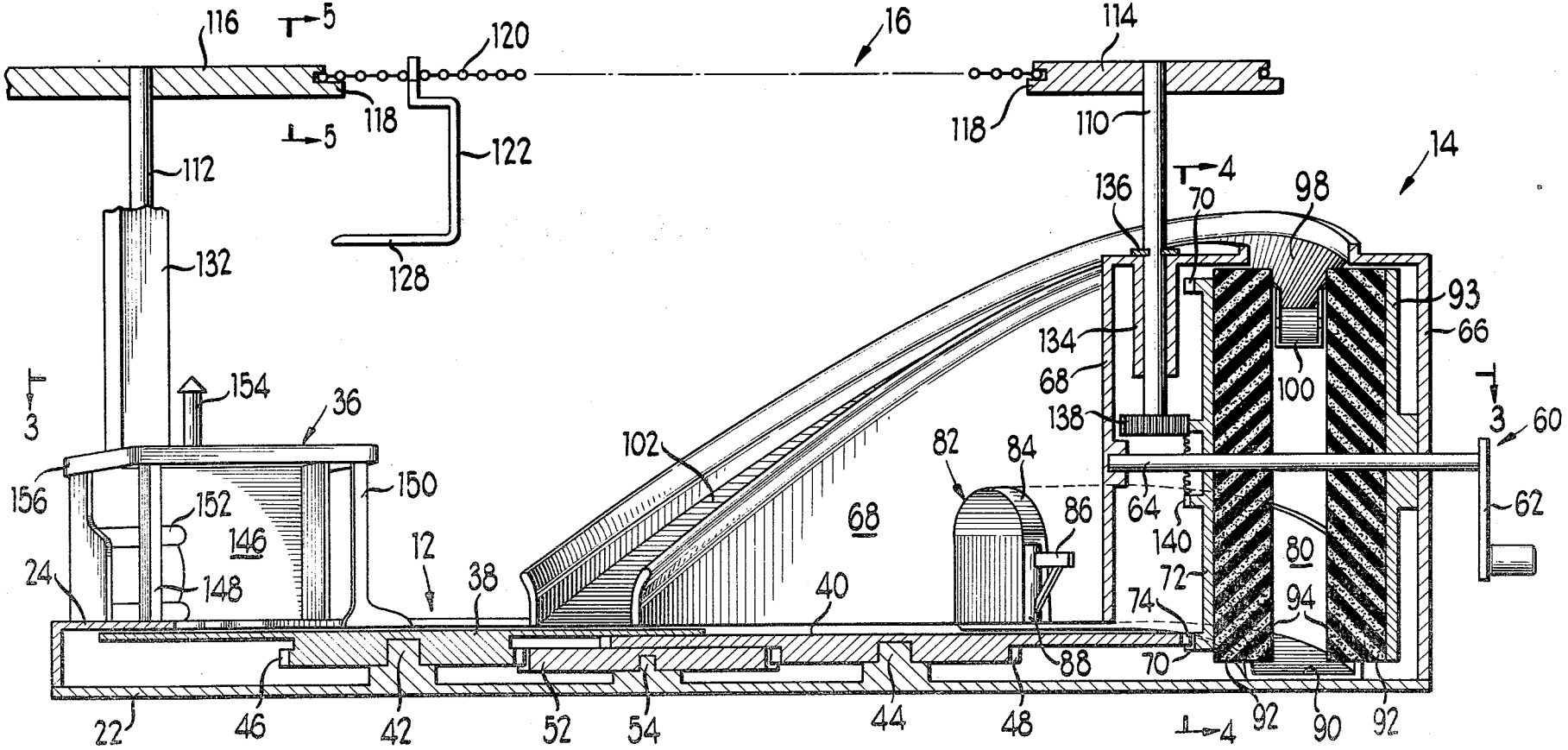
FIG. 2 is a vertical section, on an enlarged scale, taken generally along line 2—2 of FIG. 1.

Referring again to FIGS. 1, 2 and 3, the rink 12 includes a pair of rotatable platform members 38 and 40 which are rotatably mounted on shouldered shafts 42 and 44 respectively. Each of the members 38 and 40 includes a includes a flat upper face decorated to resemble a surface of ice and a gear portion 46 and 48, respectively, on the bottom side thereof which may be integrally molded with an upper circular disc portion. The member 38 includes a riser segment for supporting its upper disc portion to lie in a superior, overlapping position relative to the upper surface of the member 40 as best seen in FIG. 2. The platform members 38 and 40 are of sufficient diameter so as to extend past every point of the irregular periphery 26 of the rink. The two gears 46 and 48 mesh with a centrally mounted idler gear 52 which is rotatably mounted by a shouldered shaft 54 generally in the center of the base 20. The meshing of the gears 48, 52 and 46 is shown in dotted lines in FIG. 3 for clarity. The idler gear 52 causes both of the members 38 and 40 to rotate in the same direction at the same angular rate of speed.

A drive means, generally designated 60, includes a manually operable crank 62 which is connected to a generally horizontal shaft 64 rotatably mounted in a pair of upstanding walls 66 and 68 which also provide a housing for the recirculating means 14 to be described hereinafter. The shaft 64 carries a conjointly rotatable ring gear 70 provided on the periphery of a generally large disc 72 which meshingly engages a series of gear teeth 74 provided on the periphery of the member 40. Thus, as the crank 62 is manually rotated, the ring gear 70 drives the member 40 which in turn, through the idler gear 52, drives the member 38 at the same rate of speed, and in the same direction of rotation.

The amusement device 10 is particularly suited for use with generally egg-shaped figure toys 76 shown in phantom in FIG. 1. The figure toys 76 include a flat base portion which provides a great deal of stability to the figure toys, tending to support the figure toys in a generally vertical orientation as shown in FIG. 1. When the figure toys 76 are placed on the disc portion, either 38 or 40, rotation of the drive means 60 causes the figure toys to gradually progress outwardly due to centrifugal forces and further causing figure toys 76 on the disc 38 to be transferred onto the lower disc 40 and vice versa. Because of the two disc portions, the figure toys 76 move generally in figure "8" patterns while engaging the irregular periphery 26 and then randomly into the recirculating means 14 as described below.

Figure 4:
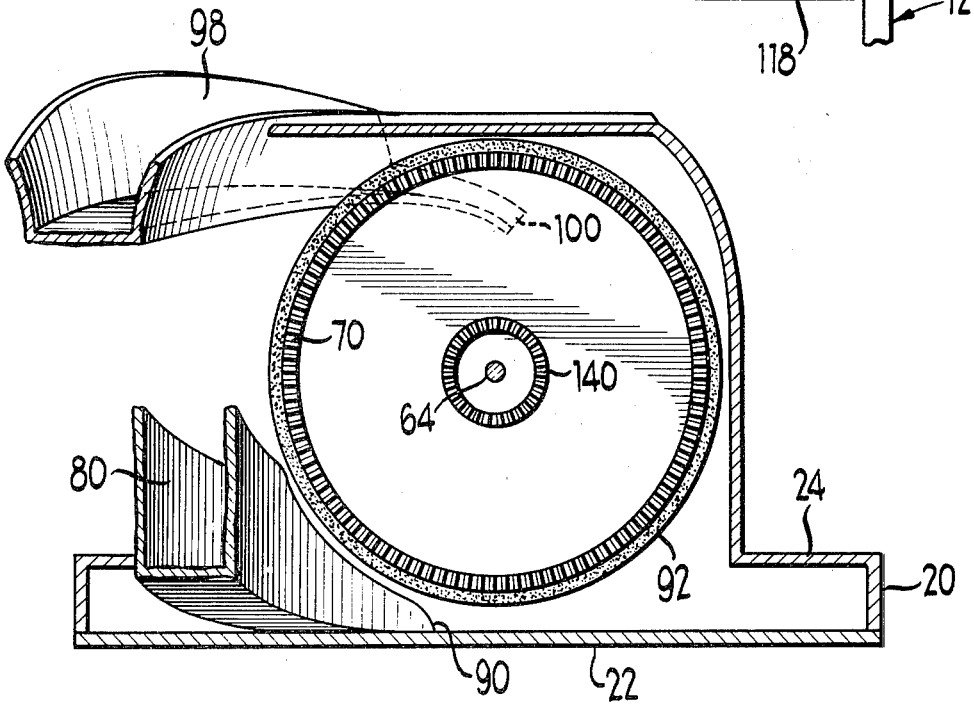
FIG. 4 is another vertical section, taken generally along line 4—4 of FIG. 2.
Figure 3:
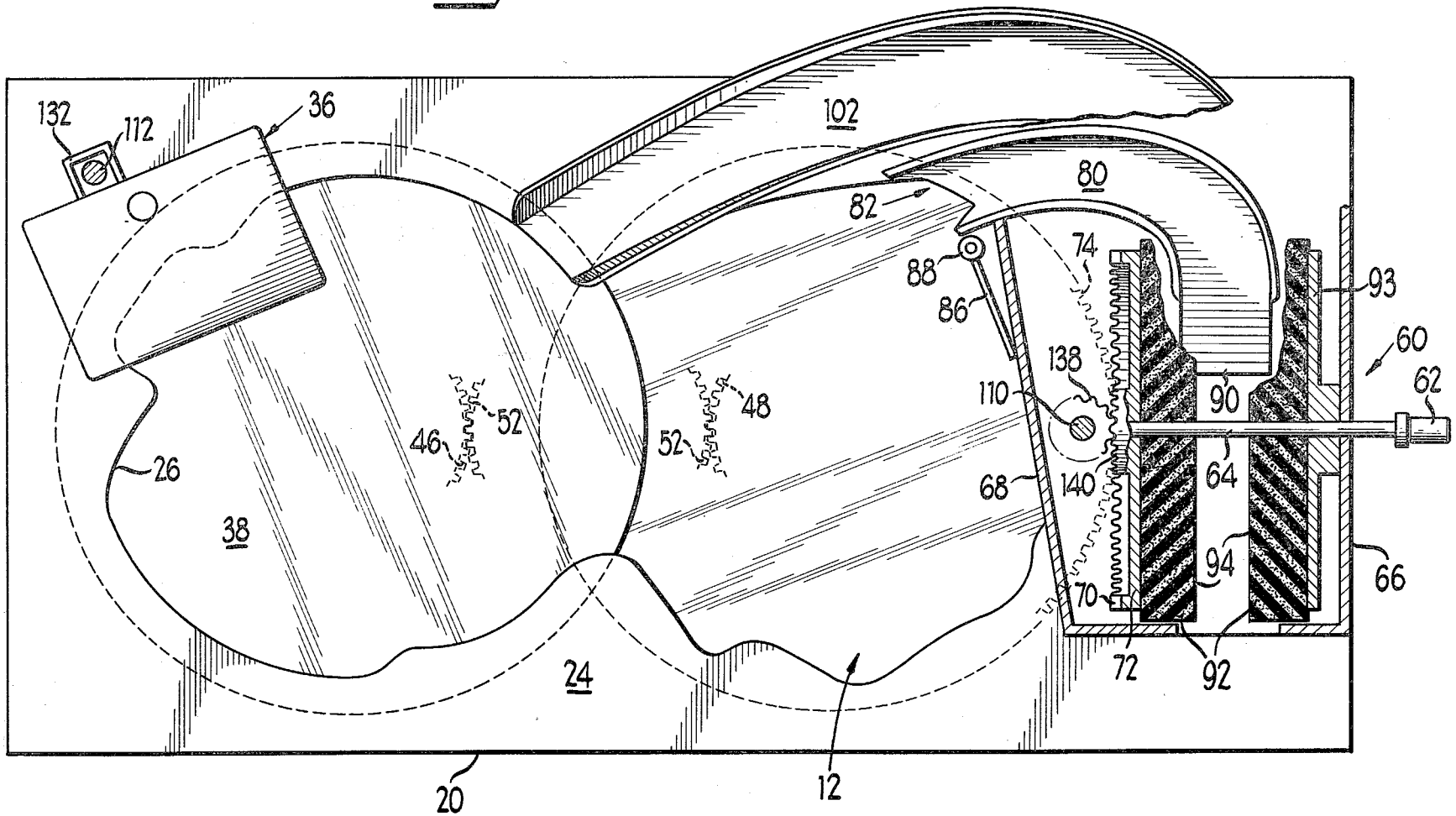
FIG. 3 is a partially fragmented, horizontal section taken generally along line 3—3 of FIG. 2.

The recirculating means 14 serve to receive the figure toys 76 from the lower disc 40 and return them, one at a time, to the upper disc 38. More particularly, referring to FIGS. 2–4, the recirculating means 14 includes an inlet chute portion 80 having an inlet opening generally designated 82, in the curved portion of the wall 68. The inlet 82 comprises an opening in the wall which is circumscribed by a generally arch-shaped flange 84. A pivotally mounted gate 86 is secured to a vertical post or shaft 88 which permits closing of the opening 82 to prevent the figure toys 76 from entering the inlet means to the inlet chute portion 80 of the recirculating means 14. The inlet chute 80 terminates at its lowest level 90 adjacent the top of the base plate 22 as seen in FIGS. 2–4. A pair of relatively thick, disc-shaped resilient members 92 are mounted on the shaft 64 for conjoint rotation therewith in a spaced apart relation as seen in FIGS. 2 and 3. The resilient discs 92 are preferably manufactured of foam material such as urethane so as to have generally flat resilient inner frictional surfaces 94 which are readily deformable when a figure toy is carried therebetween. A substantially large disc 93 on the side of the disc 92 opposite the friction surface 94 cooperates with the disc 72 to provide a stiff outer surface to maintain frictional gripping forces on the inner surfaces 94 of the discs. Thus, as a figure toy 76 passes down the inlet chute 80, it engages the inner frictional surfaces 94 of the discs 92 and is thus carried therewith during rotation of the drive means 60. The figure toys 76 are elevated by the discs 92 to the uppermost position of the periphery of the discs and then transferred to an exit chute 98 which includes a tongue portion 100 extending between the surfaces 94 (FIG. 4). Continued rotation of the drive means 60 urges the figure toy 76 toward a downwardly sloping portion 102 of the exit chute 98. Thereafter, gravitational forces cause the figure toy to be transferred down the chute portion 102 and onto the upper rotatable member 38. Thus, if the gate 86 is maintained in an open condition, as shown in FIGS. 1, 2 and 3, the figure toy 76 will travel through the inlet 82 and out to the exit chute 98 for return to the upper disc member 38 for continual movement and thus extended enjoyment and pleasure during operation of the drive means 60. Of course, the provision of an electric motor or other means to automatically drive the shaft 64 would clearly be within the scope of the present invention.

Figure 5:
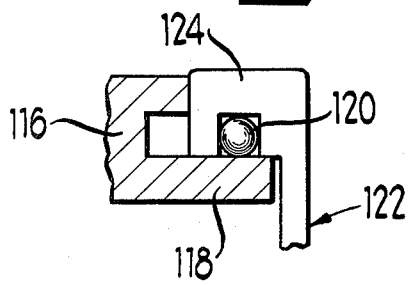
FIG. 5 is a partially fragmented, vertical section, taken generally along line 5—5 of FIG. 2 showing the removable mounting mechanism of the ski lift chairs.

The ski lift type mechanism 16 is shown in FIGS. 1 and 2 to include a pair of generally vertical, rotatable shafts 110 and 112. A grooved disc 114 and a larger grooved disc 116 is mounted on each of the shafts 110 and 112, respectively. The grooved discs 114 and 116 include a generally enlarged lower flange portion 118 which serves to maintain tracking of a bead-type continuous chain 120 fitted within the grooved portions of each of the discs. Referring to FIGS. 1 and 5, at least one lift chair 122 is removably mounted by a generally J-shaped hook portion 124 on the bead-type chain 120 for movement in a continuous path with the chain 120. Each of the chairs include a generally fork-shaped base portion 128 having a pair of spaced apart legs on each side thereof with an arcuate notch 130 in each leg which facilitates mounting of a figure toy 76 thereon.

The vertical shaft 112 is rotatably mounted within a generally rectangular housing 132 as seen in FIGS. 2 and 3. On the opposite end of the device, the other shaft 110 is mounted within a generally vertical journal 134 formed integrally with the wall 68 for rotation. A C-ring 136 or other means maintains the shaft 110 at a predetermined vertical orientation within the journal 134. A gear 138 secured to the bottom of the shaft 110 engages a smaller ring gear 140 on the disc 72 which, upon operation of the drive means 60, causes the grooved disc 114 and through the chain 120, the second grooved disc 116 to rotate moving the ski lift type chairs 122 in a continuous path. A figure toy loading position defined by a small annular flange 142 is mounted on top of the wall 68 adjacent the journal 134 to provide a position in which the figure toys 76 can be automatically loaded onto the ski chairs.

The previously described articles, including the sled 32 and the bench 30 each include one or more generally concave depressions or apertures which are particularly adapted for mounting of the egg-shaped figure toys 76. The shelter 36 includes a solid back wall portion 146 and front supports 148 and 150. The support 150 may slidingly engage the top of the rotatable platform member 38 but permits free movement thereof. A small stove or heater 152 within the shelter 36 is vented by a chimney 154 which emerges through the roof 156 of the shelter.

While the present invention has been described with reference to the particular figures, the foregoing detailed description has been given for clearness of understanding only and no unnecessary limitations should be understood therefrom as some modifications will be obvious to those skilled in the art.

We claim:

1. An amusement device, comprising:

a base having a loading station and an unloading station;

at least one rotatable platform mounted on the base and having a portion thereof adjacent said loading station and a portion adjacent said unloading station for receiving playing pieces and randomly and haphazardly delivering said playing pieces to said unloading station;

recirculating means for receiving a playing piece from the unloading station and for delivering said playing piece to the loading station on said base;

an inlet means adjacent said unloading station for receiving a playing piece from said platform;

an outlet means adjacent said loading station for delivering said playing piece to said platform; and selectively operable access means adjacent said unloading station to control movement of said playing pieces thereinto.

2. The amusement device of claim 1 wherein said recirculating means includes lift means between said inlet and outlet means for elevating an object received from said inlet for delivering to said outlet means.

3. The amusement device of claim 2 wherein said inlet and outlet means comprise canted chutes.

4. The amusement device of claim 2 wherein said lift means includes at least one vertically disposed rotatable element for frictionally engaging and vertically lifting an object received from the inlet means for delivering to the outlet means.

5. The amusement device of claim 4 wherein said lift means includes a pair of spaced apart rotatable disc elements of resilient material.

6. The amusement device of claim 5 including a pair of rigid discs secured to the outer sides of said resilient discs to limit the flexibility thereof and to provide sufficient frictional forces for lifting an object.

7. The amusement device of claim 5 including drive means for rotating said spaced apart rotatable disc elements.

8. The amusement device of claim 7 wherein said drive means includes a generally horizontal shaft rotatably mounting said resilient disc member and exposed crank means secured thereto for manual rotation.

9. The amusement device of claim 7 wherein said drive means is drivingly connected to said rotatable platform for rotation thereof in response to operation of the drive means.

10. An amusement device, comprising:

a base;

a pair of rotatable platforms mounted on the base in an overlapping relationship with one another; and recirculating means for receiving an object from a first position on one of said platforms and for delivering said object to a second position on the other of said platforms.

11. The amusement device of claim 10 including idler means between said first and second rotatable platforms for rotatingly interconnecting the platforms.

12. The amusement device of claim 11 wherein said idler means interconnects said platforms to rotate in the same direction at the same rate of rotation.

13. The amusement device of claim 12 including manual drive means for rotating said platforms.

14. The amusement device of claim 13 including a ski lift for carrying objects said ski lift being connected to said drive means and spanning said first and second rotatable platforms.

15. The amusement device of claim 10 wherein said recirculating means includes inlet means adjacent said first position on the first rotatable platform for receiving an object therefrom and an outlet means adjacent the second position on said second rotatable platform for delivering an object thereto.

16. The amusement device of claim 15 wherein said recirculating means includes a generally vertically oriented rotatable element between said inlet and outlet means for receiving an object from said inlet means and for delivering the object to said outlet means.

17. The amusement device of claim 16 wherein said inlet and outlet means comprise canted chutes.

18. The amusement device of claim 17 wherein said rotatable element comprises a pair of spaced apart, conjointly rotatable resilient members for frictionally engaging and vertically lifting the objects from the inlet to the outlet means.

19. The amusement device of claim 18 including a pair of stiff disc elements secured to the outer sides of said resilient members to limit the flexibility thereof and to provide sufficient frictional forces for lifting an object.

20. The amusement device of claim 19 including drive means for rotating said generally vertical rotatable element.

21. The amusement device of claim 20 wherein said drive means includes a generally horizontal shaft rotatably mounting said resilient member and exposed crank means secured thereto for manual rotation.

22. The amusement device of claim 21 wherein said drive means is drivingly connected to said rotatable platform for rotation thereof in response to operation of the drive means.

23. The amusement device of claim 10 including a ski lift for carrying said objects above said platform and connected to be driven by said drive means.

* * * * *